US009367976B2

(12) United States Patent
Logan et al.

(10) Patent No.: US 9,367,976 B2
(45) Date of Patent: Jun. 14, 2016

(54) METHODS, SOFTWARE, AND SYSTEMS FOR PROVIDING POLICY-BASED ACCESS

(71) Applicant: Twin Harbor Labs, LLC, Plano, TX (US)

(72) Inventors: James D Logan, Candia, NH (US); Garrett Malagodi, Hollis, NH (US); Richard A Baker, Jr., West Newbury, MA (US); David Lentini, North Berwick, ME (US)

(73) Assignee: Twin Harbor Labs, LLC, Plano, TX (US)

( * ) Notice: Subject to any disclaimer, the term of this patent is extended or adjusted under 35 U.S.C. 154(b) by 0 days.

(21) Appl. No.: 14/838,860

(22) Filed: Aug. 28, 2015

(65) Prior Publication Data

US 2016/0063780 A1 Mar. 3, 2016

Related U.S. Application Data

(60) Provisional application No. 62/043,580, filed on Aug. 29, 2014.

(51) Int. Cl.
*G07C 9/00* (2006.01)

(52) U.S. Cl.
CPC ..... *G07C 9/00031* (2013.01)

(58) Field of Classification Search
CPC ..... G07C 9/00031
USPC ..... 340/5.61
See application file for complete search history.

(56) References Cited

U.S. PATENT DOCUMENTS 4,827,395 A * 5/1989 Anders ..... G01S 13/78 340/10.1
5,315,289 A 5/1994 Fuller et al.
(Continued)

FOREIGN PATENT DOCUMENTS

CA 2799170 A1 6/2014
JP 2010226246 A 10/2010
(Continued)

OTHER PUBLICATIONS

"Access Control System", IDTECK, 2014, web page downloaded from http://www.idteck.com/en/solutions/system/accesscontrolsystem/ on Aug. 17, 2015.
(Continued)

*Primary Examiner* — Edwin Holloway, III
(74) *Attorney, Agent, or Firm* — Richard A. Baker, Jr.

(57) ABSTRACT

Methods, software, apparatus, and systems for policy-based access control are provided. In one embodiment, a method for providing policy-based access to a policy-controlled resource for a user, comprising: detecting an electronically encoded signal from a computer-controlled electronic access control service at a user-controlled computer-controlled electronic communications device proximate to the user; receiving an electronically encoded compliance query from the computer-controlled electronic access control service at the computer-controlled electronic communications device; determining an electronically encoded response to the electronically encoded compliance query using an electronically encoded, computer-controlled process on the computer-controlled computation device; and returning the electronically encoded response to the computer-controlled electronic access control service using the computer-controlled computation device.

11 Claims, 6 Drawing Sheets

(56) References Cited

U.S. PATENT DOCUMENTS

| | | | | |
|---|---|---|---|---|
| 5,583,486 | A | 12/1996 | Kersten | |
| 7,114,178 | B2 | 9/2006 | Dent | |
| 7,936,094 | B2 | 5/2011 | Rossi et al. | |
| 8,078,146 | B2 | 12/2011 | Jayappa et al. | |
| 8,326,443 | B2 | 12/2012 | Nelson et al. | |
| 8,456,308 | B2 | 6/2013 | Nelson et al. | |
| 8,514,085 | B2 | 8/2013 | Nelson et al. | |
| 8,760,260 | B2 | 6/2014 | Farioli Brioschi et al. | |
| 2003/0104848 | A1* | 6/2003 | Brideglall | G06K 7/0008 455/574 |
| 2004/0100384 | A1* | 5/2004 | Chen | G07C 9/00111 340/572.1 |
| 2005/0230596 | A1* | 10/2005 | Howell | G02C 11/00 250/200 |
| 2007/0209065 | A1 | 9/2007 | Brenam et al. | |
| 2008/0209505 | A1 | 8/2008 | Ghai | |
| 2009/0065578 | A1 | 3/2009 | Peterson et al. | |
| 2011/0006894 | A1* | 1/2011 | Witwer | F16P 3/14 340/539.11 |
| 2011/0227748 | A1* | 9/2011 | Schaible | F16P 3/14 340/686.6 |
| 2011/0288659 | A1* | 11/2011 | Nelson | G05B 9/02 700/21 |
| 2012/0326837 | A1 | 12/2012 | Ajay et al. | |
| 2013/0041525 | A1 | 2/2013 | Tomberlin | |
| 2014/0055231 | A1 | 2/2014 | Amron | |

FOREIGN PATENT DOCUMENTS

| | | | |
|---|---|---|---|
| WO | 0038119 | A1 | 6/2000 |
| WO | 2006102704 | A1 | 10/2006 |
| WO | 2013134892 | A1 | 9/2013 |

OTHER PUBLICATIONS

Kuang, Cliff, "Disney's $1 Billion Bet on a Magical Wristband", Wired, Mar. 10, 2015, web page downloaded from http://www.wired.com/2015/03/disneymagicband/ on Mar. 10, 2015.

"Door Access Control Systems Buyer's Guide and How to Manual", MagLocks, web page downloaded from http://www.maglocks.com/accessguide on Aug. 17, 2015.

* cited by examiner

416

420
Determine Query Requirements
424
Identify Proximate Devices
End
428
Device(s) Present?
No
Return Results to Access Control Service
432
Yes
436
Query Proximate Devices
440
Process Results of Query

METHODS, SOFTWARE, AND SYSTEMS FOR PROVIDING POLICY-BASED ACCESS

1. NOTICE OF COPYRIGHT

Portions of this patent application include materials that are subject to copyright protection. The copyright owner has no objection to the facsimile reproduction by anyone of the patent document itself, or of the patent application, as it appears in the files of the United States Patent and Trademark Office, but otherwise reserves all copyright rights whatsoever in such included copyrighted materials. Copyright© 2014-5 Twin Harbor Labs, All Rights Reserved.

2. BACKGROUND OF THE INVENTION

2.1 Related Applications

This application is based upon and draws its priority from U.S. Provisional Patent Application 62/043,580, "Methods, Software, and Systems for Providing Policy-Based Access", filed on Aug. 29, 2015, hereby incorporated by reference. This application also incorporates by reference U.S. Provisional Patent Application 62/170,668, "Travel Safety Control", filed on Jun. 3, 2015.

2.2 Field of the Invention

The present invention provides systems, apparatus, software, and methods for providing policy-based access to various user resources, such as, but not limited to restricted areas and devices (e.g., machines and vehicles). The present invention has application in the fields of security systems, computer science, and electronic communications.

2.3 The Related Art

Many situations in industry, business, and other aspects of modern life require controlled access to particular locations, machines, or other equipment. Often such situations arise because personnel and other individuals can safely or securely access such locations and devices when in possession of one or more devices, such as hard-hats, reinforced foot protection, breathing apparatus, safety harnesses, protective clothing, fire ground safety and rescue gear, and the like. In order to establish such controlled access, a management function, e.g., a safety or security committee, establishes policies setting forth the various requirements and rules to allow individuals access to the locations and devices that fall within the scope of the policy. Establishing and enforcing such policies is often important to protect businesses from theft and insurance claims arising from accidents.

Enforcing these policies, however, is not easy. Often personnel trained in the policy and its enforcement must be provided to watch the location or device to detect violators, which necessitates expensive training and outfitting. The personnel must also have authority to intercept potential violators and stop possibly violating actions. Such requirements can create conditions that create further risks by putting employees in conflict, which can create strains in an organization. Moreover, the enforcement process is itself often inefficient, with gaps in coverage or errors in observation of personnel causing violations of access policies.

It would thus be useful to have a more automated system of enforcing policy-based access to resources. The benefits of such a system would be the removal, or reduction, of human error in enforcement; the removal of potential conflicting situations between employees; and the reduction in cost to provide needed oversight. But the availability of these systems is severely limited by the need to provide specialized equipment and the limited scope of enforcement.

In particular, current systems cannot reliably determine, if at all, whether personnel have necessary equipment (e.g., safety equipment like hard-hats) when seeking access to a policy controlled resource like a construction site or heavy machinery. The present invention meets these and other needs.

3. SUMMARY OF EMBODIMENTS OF THE INVENTION

The present invention provides solutions to the above-described limitations of the prior art. More particularly, the present invention provides methods, systems, apparatus, and software that enable the efficient control of policy-based access to resources.

In one aspect, the present invention provides a self-identifying device. In one embodiment, the self-identifying device comprises a device having a device identifier attached thereto, the device identifier including: a power source; communications means for receiving and sending signals; a data processor; and data storage containing encoded information about the identity and properties of the device.

In a more specific embodiment, the data storage further contains information about the user of the equipment. In a still more specific embodiment, additionally the communications means is configured to send and receive Bluetooth signals.

In one aspect, the present invention provides methods for providing policy-based access control. In one embodiment, a method for providing policy-based access to a policy-controlled resource for a user, comprising: detecting an electronically encoded signal from a computer-controlled electronic access control service at a user-controlled computer-controlled electronic communications device proximate to the user; receiving an electronically encoded compliance query from the computer-controlled electronic access control service at the computer-controlled electronic communications device; determining an electronically encoded response to the electronically encoded compliance query using an electronically encoded, computer-controlled process on the computer-controlled computation device; and returning the electronically encoded response to the computer-controlled electronic access control service using the computer-controlled computation device.

One embodiment of the method just described further includes starting an electronically encoded computer-controlled compliance determination process on the computer-controlled electronic communications device. A more specific embodiment further includes sending under computer control an electronically encoded response from the computer-controlled electronic communications device to the computer-controlled electronic access service in response to the electronically encoded signal. A still more specific embodiment still further includes searching under computer control for at least one electronically encoded signal corresponding to at least one aspect of the electronically encoded compliance query. In a yet more specific embodiment, the electronically encoded signal is a Bluetooth-encoded signal. A more specific embodiment, further comprises in addition to the foregoing receiving an electronically encoded compliance answer from the computer-controlled electronic access control service at the computer-controlled electronic communications device.

In another aspect, the present invention provides a method for providing policy-based access to a policy-controlled resource for a user, comprising: sending an electronically encoded signal from a computer-controlled electronic access control service to a user-controlled computer-controlled electronic communications device proximate to the user; sending an electronically encoded compliance query from the computer-controlled electronic access control service to the computer-controlled electronic communications device; receiving an electronically encoded response to the electronically encoded compliance query from the computer-controlled electronic communications device; and processing the electronically encoded response under an electronically en-coded computer-controlled process, the process being configured to determine whether to grant access to the policy-controlled resource.

In one embodiment of this aspect of the invention, the electronically encoded signal is configured to start an electronically encoded computer-controlled compliance determination process on the computer-controlled electronic communications device. A more specific embodiment of this method further includes receiving under computer control an electronically encoded response from the computer-controlled electronic communications device in response to the electronically encoded signal. In a still more specific embodiment, additionally the electronically encoded query is configured to enable the computer-controlled access control service to determine using an electronically encoded process under computer control whether the conditions of a policy controlling access to the resource are met.

In still another aspect, the present invention provides a computer-controlled, electronic system for providing policy-based access to a policy-controlled resource for a user, comprising: a computer-controlled electronic access control service configured to send an electronically encoded query to a user-controlled computer-controlled electronic communications device proximate to the user, the electronically encoded query being configured to enable the computer-controlled access control service to determine using an electronically encoded process under computer control whether the conditions of a policy controlling access to the resource are met; and process an electronically encoded response to the query from the computer-controlled electronic communications device using an electronically encoded computer-controlled process configured to determine whether to grant access to the policy-controlled resource to determine whether the conditions for the policy-based access have been satisfied.

These details, and still further aspects and advantages, will become apparent to those having ordinary skill in the art when the following Detailed Description is read in conjunction with the accompanying Drawings.

4. BRIEF DESCRIPTION OF THE DRAWINGS

Exemplary embodiments of the present invention are described herein with reference to the following drawings, in which.

Figure 4A:
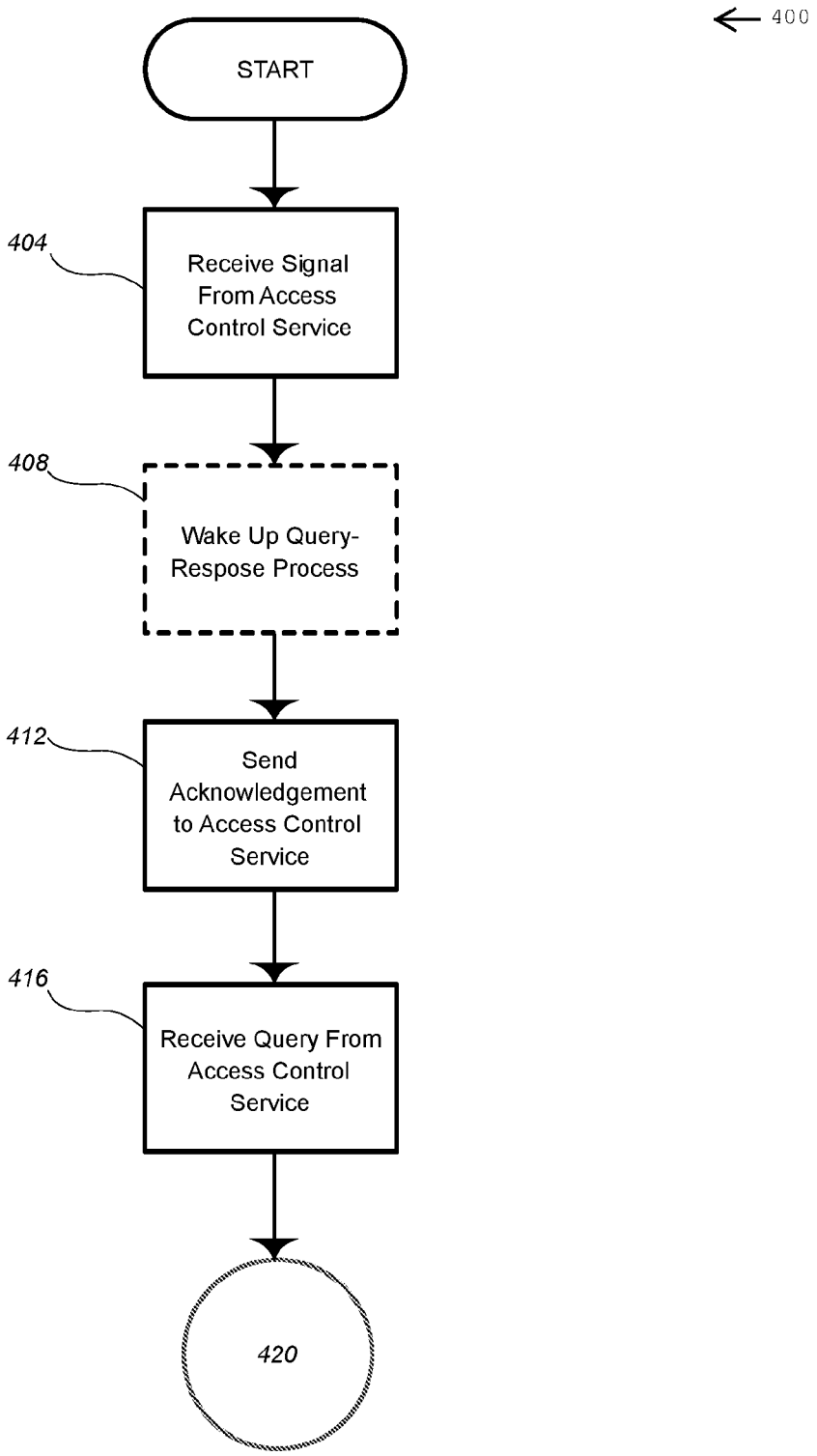
Figure 4B:
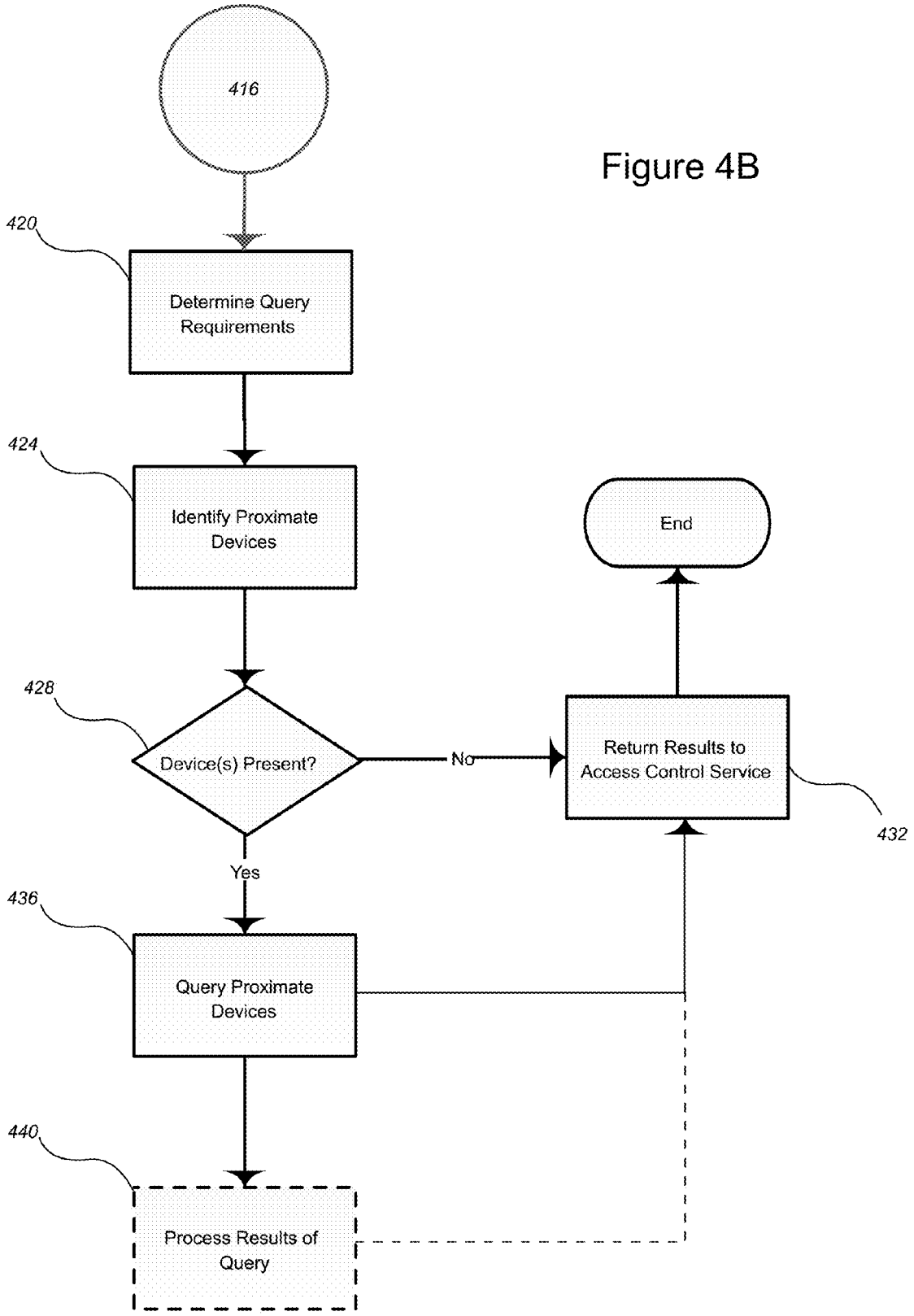

FIGS. 4A and 4B are flowcharts illustrating one embodiment of the invention. FIG. 4A illustrates the activation of a user's computer-controlled electronic communications device and response to a query from an Access Control Service in accordance with the present invention. FIG. 4B is a continuation of the process described in FIG. 4A.

Figure 5:
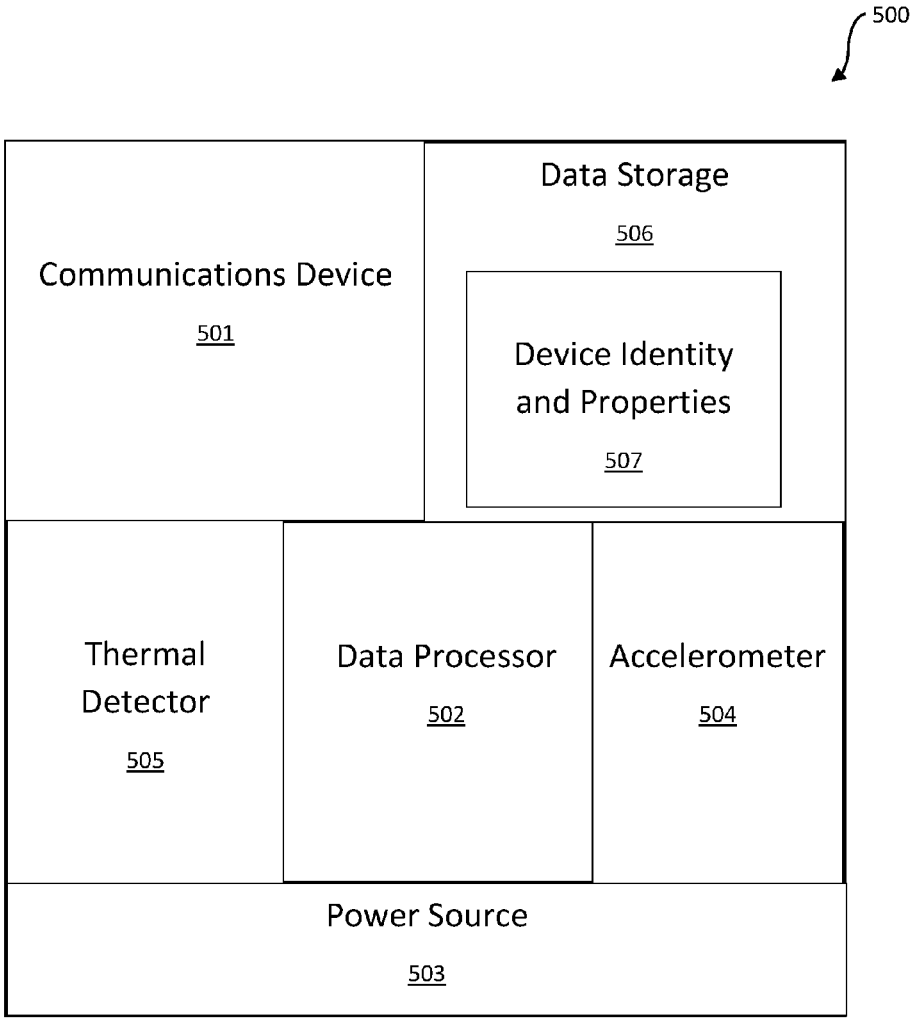

FIG. 5 is a diagram illustrating one embodiment of the device identifier.

5. DETAILED DESCRIPTION OF SOME EMBODIMENTS OF THE INVENTION

Figure 1:
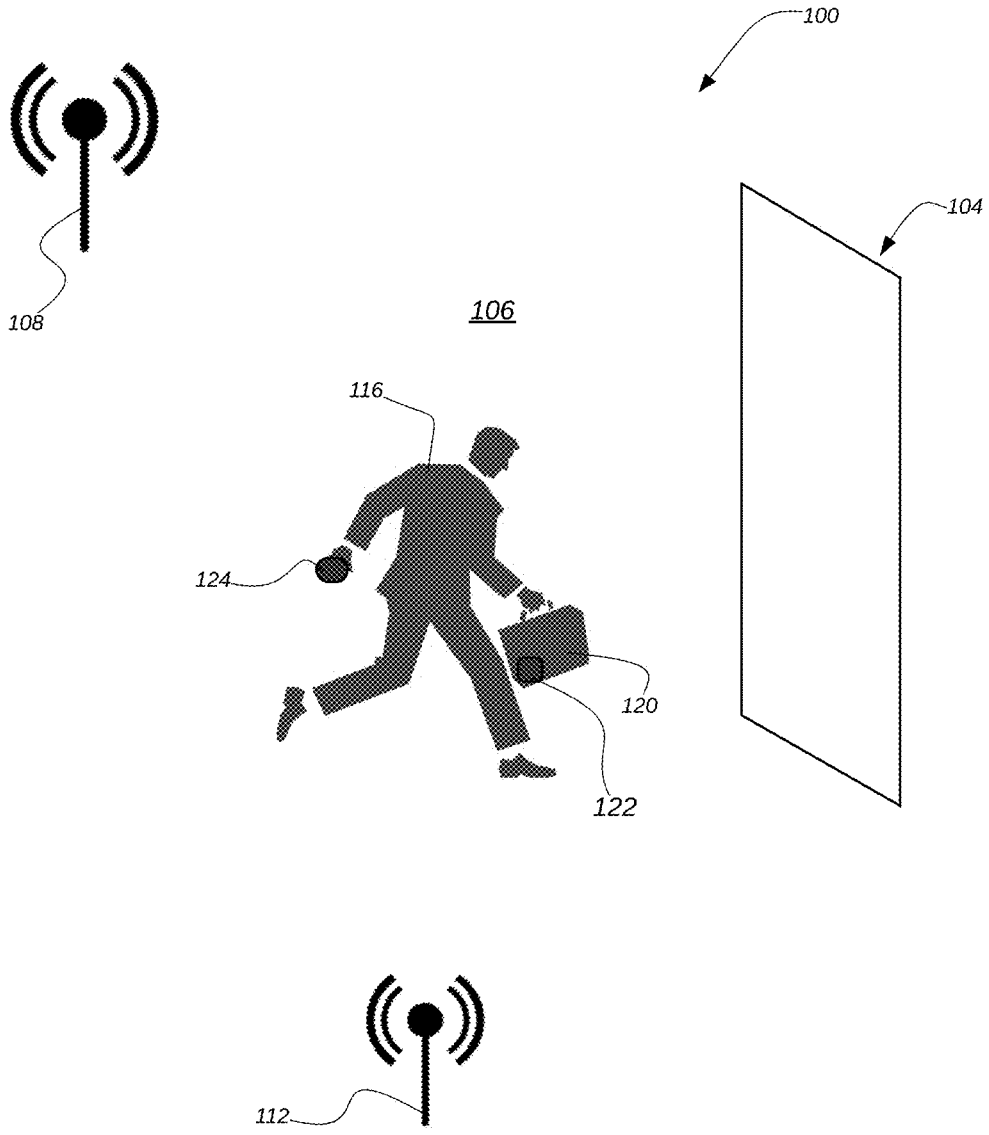
FIG. 1 is an illustration of a user approaching a policy-controlled access point in accordance with the present invention.

FIG. 1 illustrates one aspect of the invention at 100. There, the area 106 proximate to a door 104 or other access to a policy-controlled area (not shown) is covered by antennas 108 and 112. Door 104 can be any sort of portal or other physical barrier or demarcation separating the policy-controlled area from the area outside of such control. Examples of policy-controlled areas include without limitation areas requiring safety equipment such as hard-hats, boots, eye protection, safety harnesses, protective clothing, fire ground safety and rescue gear; and areas requiring specialized tools or other devices. Control of entry into the policy-controlled area can be performed by locking door 104 or other access portal, or by providing an alarm or other notification if unauthorized access to the controlled area is attempted. Antennas 108 and 112 are capable of communicating with a computer-controlled electronic communications device as described herein below. The policy governing the policy-controlled area is any single or group requirements established to determine who and what are able to enter the policy-controlled area. The provision of these elements and their operation will be familiar to those having ordinary skill in the art.

User 116 represents anyone seeking access to the controlled area via door 104, such as a worker, manager, or visitor. The user carries a device 120, which is necessary for the user to meet the requirements of the policy and pass through door 104. Device 120 can be anything required to be proximate to the user that is required by the policy governing access to the policy-controlled area as described above. The device further includes a device identifier 122 that identifies the device and, in some embodiments of the invention, provides information about the device and its status. In some embodiments, the device uses Bluetooth communications components and methods; in other embodiments, RFID or near-field communications are used instead of, or in addition, Bluetooth. In more specific embodiments, the device is a Bluetooth tag that is associated with the device. In some embodiments, the tag is detected by the user's computer-controlled electronic communications device (124), described in more detail herein below, one or more of the antennas 108 and 112, or both. In still other embodiments, the invention provides for the detection of unauthorized entry by the passing of unknown or unresponsive (or both) Bluetooth, RFID, near-field, Wi-Fi, cellular signals, or the like, passing an antenna. The provision of these elements and their operation will be familiar to those having ordinary skill in the art.

In some embodiments, such as seen in FIG. 5, the device identifier 500 includes a power source 503, communications means for sending and receiving signals 501, a data processor 502, and data storage 506 containing electronically encoded information about the identity and properties 507 of said device. In more specific embodiments, the data storage 506 further contains information about the user of said equipment. In still more specific embodiments, the communications device 501 is configured to send and receive Bluetooth signals; in other embodiments, RFID or near-field communications are used instead of, or in addition, Bluetooth. The device identifier 500 may be attached to the safety equipment using and attachment mechanism such as adhesive, zip tie, string, thread, tape, screws, nails, or other mechanical means. The device identifier 500 could be built into the safety equipment.

In another embodiment the device identifier 500 further includes an accelerometer 504. The accelerometer 504 could detect motion patterns and the data processor 502 could compare these patterns to known patterns. For instance, if the device identifier 500 is attached to a hard hat, the accelerometer readings could be compared to the patterns of an accelerometer 504 when worn on the head. This could be used to assure the hard hat is worn and not just carried. Or the accelerometer 504 in a device identifier 500 attached to a pair of goggles at a saw mill could indicate that the goggles were vertical, implying that the goggles were on the face protecting the user's eyes.

In another embodiment, a thermal detector 505 could be incorporated in the device identifier 500, detecting body heat to determine if the equipment attached to the device identifier 500 is being worn. For instance, the device identifier 500 could be attached to gloves at a band saw, and the thermal sensor 505 could detect if the gloves were on the hands. The provision of these elements and their operation will be familiar to those having ordinary skill in the art.

The user also carriers a computer-controlled electronic communications device (124), such as a smartphone, tablet computer, personal data assistant ("PDA"), or the like. Examples of suitable devices are those using the Android operating system (Google, Mountain View, Calif.) and the iOS operating system (Apple Computer, Cupertino, Calif.). Still other suitable devices and operating systems will be recognized by those having ordinary skill in the art. The device is capable of receiving signals from, and sending signals to, antennas 108 and 112 and device 120. The configuration and operation of the computer-controlled electronic communications device will be described in greater details herein below. The provision of these elements and their operation will be familiar to those having ordinary skill in the art.

Figure 2:
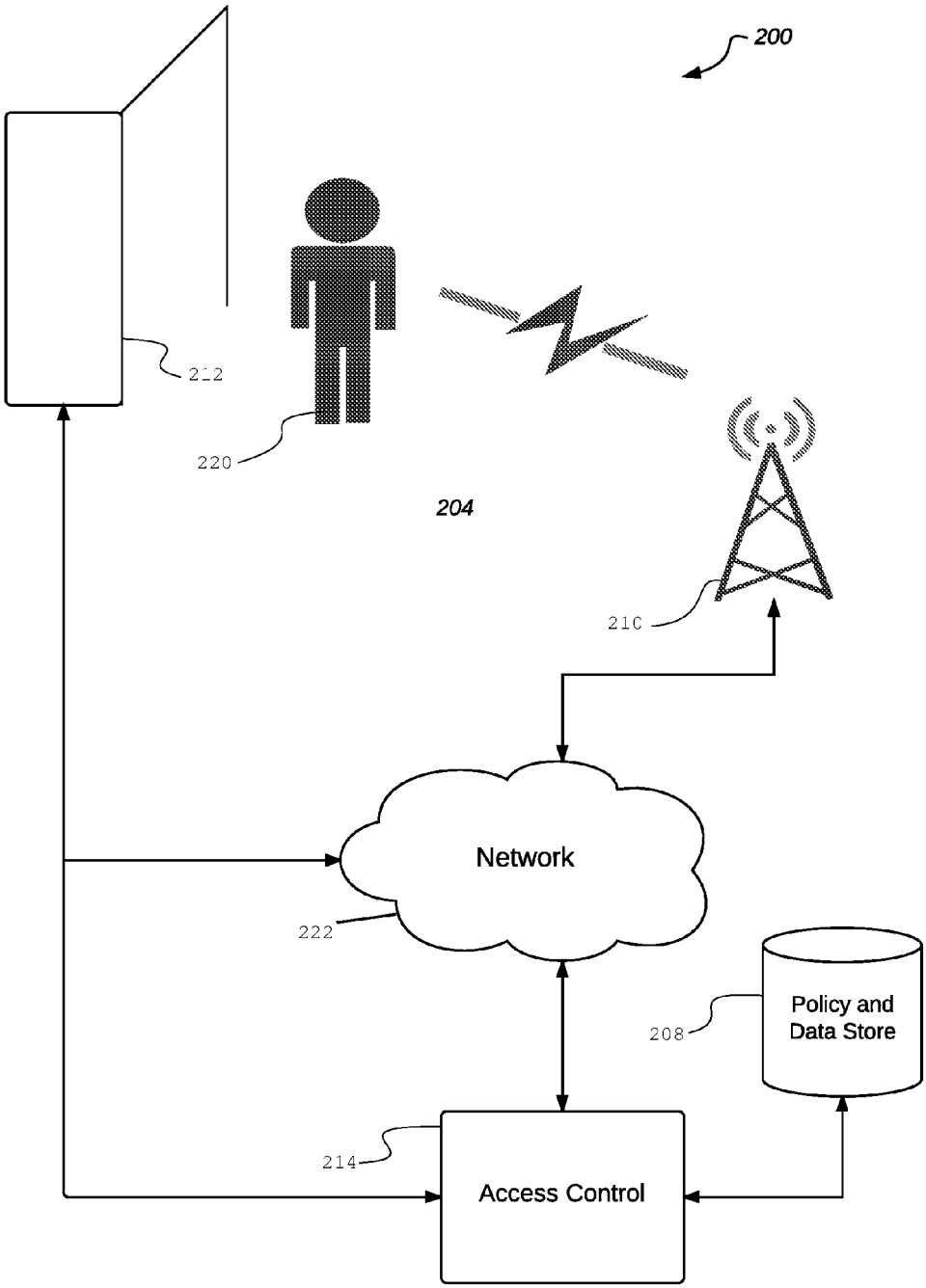
FIG. 2 is a schematic illustration of a system for policy-based access control in accordance with one embodiment of the present invention.

FIG. 2 provides a schematic view of an embodiment of a system aspect of the invention (200). There, an Access Control Service 204 is in bi-directional communication, either directly or over an electronic communications network 222, with a Policy and Data Store 208 to provide policy-based control to a policy-based controlled area (not shown). Service 204 is configured to determine the appropriate policy (or policies) controlling access to the area in question, the requirements of the policy (or policies), queries to obtain the information necessary to determine compliance with the policy or policies, and then enable or prevent access to the controlled area. In a non-limiting example, the Access Control Service includes an electronic computer that is configured to execute electronically encoded instructions on electronically encoded data. The electronically encoded instructions are configured to enable the Access Control Service to execute its functions, including those just described. The Policy and Data Store 208 includes electronically encoded data and instructions that are used by the Access Control Service to determine compliance. Thus, the Policy and Data Store includes electronically encoded data and instructions identifying and describing the various policies executed by the Access Control Service. The provision of these elements and their operation will be familiar to those having ordinary skill in the art.

The Access Control Service is also in bi-directional communication (either directly or over an electronic communications network) with a portal 212 demarcating the policy-controlled area from non-controlled areas (including areas under control of a different policy or policies). The portal has the general description provided for door 104 in FIG. 1. Thus, in some embodiments, portal 212 is a physical barrier that prevents access until a signal or other action from the Access Control Service enables removal or movement of the barrier. In other embodiments, the portal 212 is not a physical barrier, but includes one or more notices or alarms (or both) that are either activated or de-activated by the Access Control Service depending on the result of its analysis as described herein. The provision of these elements and their operation will be familiar to those having ordinary skill in the art.

The Access Control Service also engages in bi-directional communication (either directly or over an electronic communications network) with one or more antennas or other devices that enable the transmission of electronically encoded signals between a user 220 and the Access Control Service. Such signals can be transmitted using methods such as cellular communications 210, Wi-Fi, radio, microwave, and other means familiar to those having ordinary skill in the art. The signals include signals encoded to broadcast the presence of the Access Control Service, which are sent at regular intervals to engage with a user's computer-controlled electronic communications device (124) as described herein. The provision of these elements and their operation will be familiar to those having ordinary skill in the art.

Figure 3:
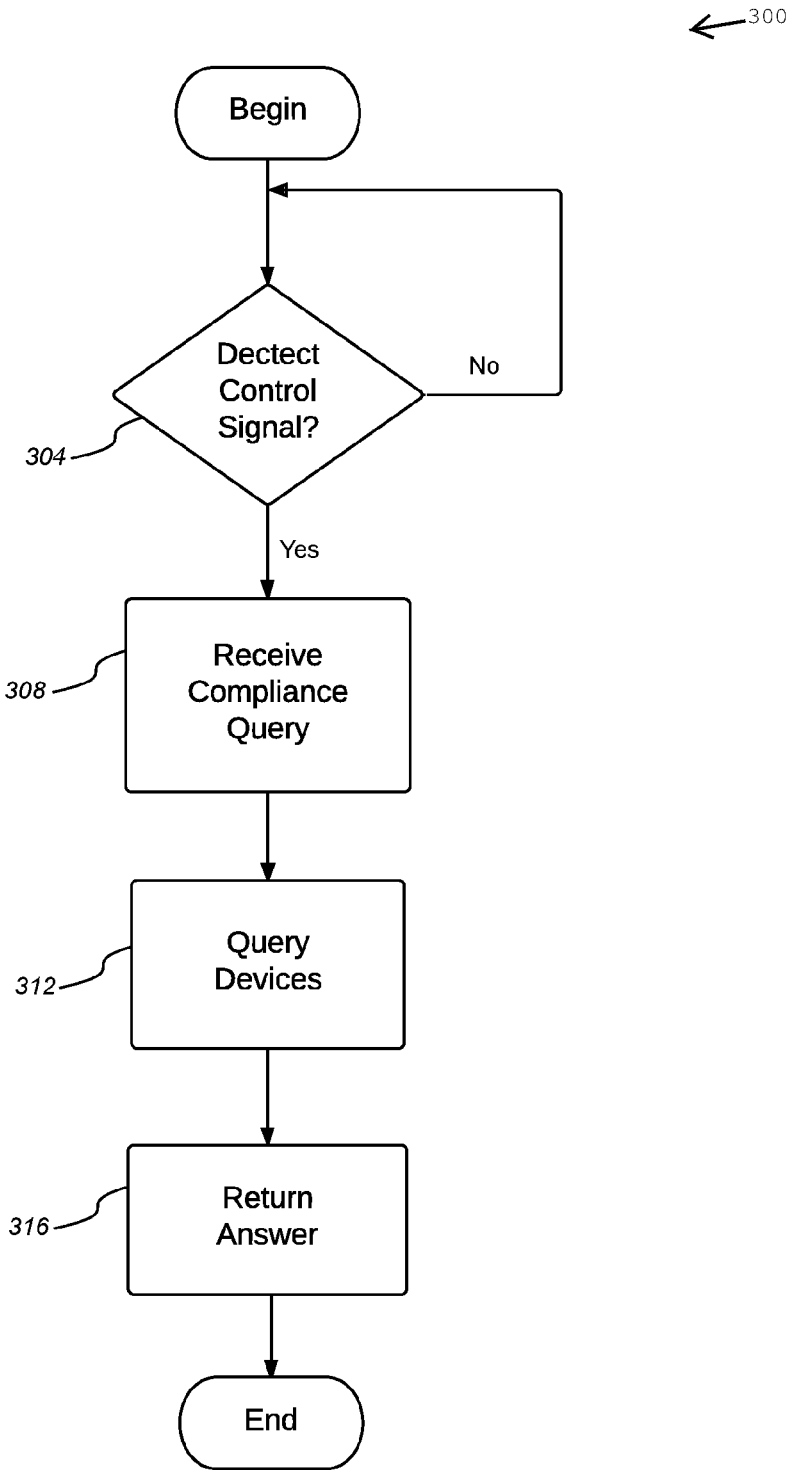
FIG. 3 is a flowchart illustrating one embodiment of the invention.

FIG. 3 provides an illustration of one exemplary embodiment of a method for providing policy-controlled access in accordance with the present invention from the perspective of the user's computer-controlled electronic communications device (300). The device executes a "wait loop" (304 in which no action relevant to accessing a policy-controlled area occurs until receiving a signal from the Access Control Service. When the signal is received, the device receives a compliance query from the Service (308). The content of the query is determined by the data and policies in the Policy and Data Store as executed by the Access Control Service. The user's device then queries other devices proximate to the user to provide a response to the query (312). The device then returns an answer to the Access Control Service (316). The provision of these elements and their operation will be familiar to those having ordinary skill in the art.

FIG. 4A illustrates at 400 a more detailed embodiment of the communications between the user's computer-controlled electronic communications device and the Access Control Service. The user's device receives a signal from the Access Control Service announcing the presence of the Service as described above with respect to FIG. 2. In some embodiments, the signal causes the user's device to start a Query Response Process (408). Examples of such activation can be found, e.g., in U.S. Pat. Nos. 7,873,390; 7,929,959; 8,798,677; Chinese Patent Application No. CN103365441; and Published U.S. Patent Application Publication No. 2014/0106734. Each of these U.S. patents and patent publication (with the exception of Chinese Patent Application No. CN103365441) are incorporated herein by reference in its entirety and for all purposes. In other embodiments, the Query Response Process is running in the user's device as an active process or a daemon waiting to be woken to a fully active state upon receipt of the signal. The provision of these elements and their operation will be familiar to those having ordinary skill in the art. Upon activation, however that is accomplished, the user's device sends an acknowledgment to the Service (412). The Service then generates the appropriate query or queries, which are received by the user's device (416). The provision of these elements and their operation will be familiar to those having ordinary skill in the art.

Turning to FIG. 4B, the process continues at 420, where process now running on the user's device determines the requirements of the query. The user process then identifies the proximate devices (424). If no device is present, then an appropriate result is returned to the Access Control Service and the process ends (428, 432). If a device (or devices) is (are) present, then the device(s) are queried (436) and the results are relayed to the Access Control Service (432). In some embodiments, the results are processed on the user's device prior to relay (440). The provision of these elements and their operation will be familiar to those having ordinary skill in the art.

In some embodiments, the user's device locates proximate devices by searching for electronically encoded signals from the device. In more specific embodiments, the signals are Bluetooth-encoded signals; in other embodiments, RFID or near-field communications are used instead of, or in addition, Bluetooth. In still more specific embodiments, the Bluetooth signals are from "tags" that provide an identifier, such as a serial number or the like, that is associated with a description or identifier of the device. In some embodiments, the user's device is responsible for determining the identification of the proximate device from the signal, e.g., by referring date stored on the user's device or by separate query to the Access Control Server, e.g., provided by the Access Control Service with the original query, or through another server. In alternative embodiments, the user's device relays the identifier to the Access Control Service for processing by the Access Control Service. Still other methods and materials for device identification will be apparent to those having ordinary skill in the art. The provision of these elements and their operation will be familiar to those having ordinary skill in the art.

Once the Access Control Service receives the response to the query from the user's device, the Service processes the query to determine if the policy requirements for access have been met. If the result is affirmative, then the Access Control Service enable access to the policy-controlled area by the user. This can be accomplished by enabling physical access, e.g., unlocking or unblocking a door, or by disabling an alarm or other warning. In addition, in some embodiments the Access Control Service sends a reply to the user's device indicating approval, e.g., by a sound or visual cue, or both. If the policy requirements are not met, then the Access Control Service prevents access, e.g., by maintaining or initiating a lock or block of a door, or by activating an alarm or warning. In addition, in some embodiments the Access Control Service sends a reply to the user's device indicating approval, e.g., by a sound or visual cue, or both. The provision of these elements and their operation will be familiar to those having ordinary skill in the art.

5.1 Example

In one illustrative and non-limiting example, a user seeks to enter a policy-controlled work area that requires both a hard-hat and protective boots. The area is separated by a locked door that can be unlocked by a signal from an Access Control Service, configured as described herein, if the necessary policy conditions are met. The user carries a smartphone, such as an Android or Apple iPhone, that is configured to provide the functionalities described hereinabove.

As the user enters the uncontrolled area, his (or her) smartphone receives signals from the Access Control Servers that initiate a process to respond to queries from the Access Control Service. When the process is running, it sends to the Access Control Service a response that causes the Access Control Service to forward the query appropriate for access to the controlled area. The process receives the query and determines which devices are needed to demonstrate access. Alternatively, the query simply tells the process to locate all devices proximate to the user. In a second alternative, the query more specifically identifies the devices to boots and a hard-hat.

The process then seeks Bluetooth signals proximate to the user; in other embodiments, RFID or near-field communications are used instead of, or in addition, Bluetooth. If no Bluetooth (or equivalent) signals are received, then the process returns that result; the Access Control Service determines the policy conditions have not been met; and sends an exception to the user and maintains the lock. If Bluetooth signals are received, then the process either determines the corresponding identifiers and their corresponding device identities (i.e., if they are from the boots and hard-hat), or the process forwards the corresponding identifiers to the Access Control Service for further analysis. If the Access Control Service determines that the identifiers are sufficient to allow the users to meet the policy requirements for access, then the Access Control Service unlocks the door and sends a corresponding reply to the process, which then notifies the user. If the Access Control Service determines that all of the identifiers are present, but not sufficient (e.g., wrong type of boots or hard-hat), or that at least one identifier is not present (e.g., the hard-hat is present, but not the boots), then the Service denies access as just described.

In another embodiment, the computer-controlled electronic communications device (124) could interrogate other computer-controlled electronic communications devices proximate to the computer-controlled electronic communications device (124) to see if these other devices have located device identifiers 122 attached to safety equipment. If the computer-controlled electronic communications device (124) is not connected to similar equipment, the computer-controlled electronic communications device (124) could sound an alarm. For instance, if the user's cell phone checks with the nearby cell phones of other users, and finds that everyone else is wearing a hard hat but the user is not, the cell phone would sound an alarm.

In another embodiment, a police department could establish a virtual zone around a dangerous situations by defining the protected zone using IPS, beacons, GPS, Assisted GPS, U-TDOA or other similar technologies to map out the area. This is the policy-controlled area. A wireless protocol, such as cellular, Wi-Fi, or Bluetooth can then be used to identify all devices (computer-controlled electronic communications device (124)) within the protected zone or that are entering the protected zone. Each police officer runs an app on their cell phones that connects to tags 122 on the equipment that they are carrying. The tags 122 may be placed on the bullet proof vests, their uniforms, various radios and weapons. When the police office enters the protected zone (and while in the protected zone), the cell phone app takes an inventory of the equipment that he is carrying. The app then reports this equipment to a central computer (Access Control Service) that maps where all of the police officers are located along with the equipment they are carrying. This will allow police supervisors to locate needed equipment within the protected zone, such as an officer with a particular weapon.

Should the police supervisors decide that all police officers located in the protected zone must be wearing certain equipment, such as a bullet proof vest, then every police officer entering the protected zone will be warned if they attempt to enter the protected zone without the bullet proof vest, and the central computer will be notified if they continue into the protected zone. All police officers within the protected zone at the time that the requirement is set may also be warned that they are not in compliance. This embodiment could also be extended to firefighters at the scene of a fire.

6. CONCLUSION

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. A self-identifying device, the self-identifying device comprising:

a device identifier, said device identifier providing a unique identity for the device;

a power source;

a data processor for transmitting the device identifier over a communications interface, said data processor receiving power from said power source;

a data storage containing encoded information, said encoded information including the device identifier, the data storage connected to said data processor;

an accelerometer connected to the data processor, wherein the data processor compares data from said accelerometer to known accelerometer data patterns to determine if the safety equipment is being properly worn;

the communications interface, connected to said data processor, for receiving and sending signals, said signals encoded with the encoded information and with information regarding a presence of the self-identifying device, said signals exchanged with a smartphone configured to monitor the presence of said self-identifying device area within a policy controlled; and an attachment mechanism for mechanically coupling the self-identifying device to safety equipment.

2. The self-identifying device of claim 1 wherein the communications interface utilizes a Bluetooth protocol.

3. A method for providing policy-based access control, said method providing policy-based access to a policy-controlled resource for a user, comprising:

detecting an electronically encoded signal from a computer-controlled electronic access control service at a user-controlled smartphone proximate to the user;

receiving an electronically encoded compliance query from the computer-controlled electronic access control service at the smartphone;

starting an electronically encoded computer-controlled compliance determination process on the smartphone;

searching under computer control for at least one electronically encoded signal corresponding to at least one aspect of the electronically encoded compliance query, wherein the electronically encoded signal further corresponds to presence of safety equipment;

determining an electronically encoded response to said electronically encoded compliance query using an electronically encoded, computer-controlled process on said computer-controlled computation device; and returning said electronically encoded response to said computer-controlled electronic access control service using the computer-controlled computation device, said electrically encoded response including presence data regarding the presence of said safety equipment and usage data relating to whether the safety equipment is being properly worn, the usage data derived from a comparison of accelerometer data with known accelerometer data patterns.

4. The method for providing policy-based access control of claim 3, further comprising sending under computer control an electronically encoded response from said smartphone to said computer-controlled electronic access service in response to said electronically encoded signal.

5. The method for providing policy-based access control of claim 3 wherein the electronically encoded signal is a Bluetooth-encoded signal.

6. The method for providing policy-based access control of claim 3, further comprising receiving an electronically encoded compliance answer from said computer-controlled electronic access control service at said smartphone.

7. The method for providing policy-based access control of claim 3, further comprising enabling access to said policy-controlled resource.

8. The method for providing policy-based access control of claim 3, further comprising denying access to said policy-controlled resource.

9. The method for providing policy-based access control of claim 3 wherein the least one electronically encoded signal is transmitted over a Bluetooth network.

10. A computer-controlled, electronic system for providing policy-based access to a policy-controlled resource for a user, comprising:

a computer-controlled electronic access control service configured to send an electronically encoded query to a user-controlled smartphone proximate to said user, said electronically encoded query being configured to enable said computer-controlled access control service to determine using an electronically encoded process under computer control whether the conditions of a policy controlling access to said resource are met, wherein said policy includes a presence of safety equipment proximate to said user and a determination of whether the safety equipment is being properly worn, the determination derived from a comparison of accelerometer data with known accelerometer patterns; and process an electronically encoded response to said query from said smartphone using an electronically encoded computer-controlled process configured to determine whether to grant access to said policy-controlled resource to determine whether the conditions for said policy-based access have been satisfied.

11. The computer-controlled, electronic system for providing policy-based access to a policy-controlled resource for a user of claim 10, wherein the electronically encoded query is transmitted over a Bluetooth network.

* * * * *

UNITED STATES PATENT AND TRADEMARK OFFICE

CERTIFICATE OF CORRECTION

PATENT NO. : 9,367,976 B2
APPLICATION NO. : 14/838860
DATED : June 14, 2016
INVENTOR(S) : James Logan et al.

It is certified that error appears in the above-identified patent and that said Letters Patent is hereby corrected as shown below:

In the Claims

Column 9 line 25 delete the word "the" before the words "safety equipment"

Signed and Sealed this
Ninth Day of August, 2016

Michelle K. Lee

Michelle K. Lee
*Director of the United States Patent and Trademark Office*